US008651828B2

(12) United States Patent
Sundheim

(10) Patent No.: US 8,651,828 B2
(45) Date of Patent: Feb. 18, 2014

(54) VACUUM PUMP WITH COMBINED DEBRIS CATCHER AND PRESSURE RELIEF VALVE

(76) Inventor: Gregory S. Sundheim, Bowmar, CO (US)

( * ) Notice: Subject to any disclaimer, the term of this patent is extended or adjusted under 35 U.S.C. 154(b) by 189 days.

(21) Appl. No.: 12/557,912

(22) Filed: Sep. 11, 2009

(65) Prior Publication Data

US 2010/0068077 A1 Mar. 18, 2010

Related U.S. Application Data

(60) Provisional application No. 61/096,653, filed on Sep. 12, 2008.

(51) Int. Cl.
*F04B 49/00* (2006.01)
*F04B 53/20* (2006.01)
*F04B 49/24* (2006.01)

(52) U.S. Cl.
USPC ..... 417/307; 417/313; 417/440; 55/310

(58) Field of Classification Search
USPC ..... 417/307, 313, 440; 55/310, 311, 417
See application file for complete search history.

(56) References Cited

U.S. PATENT DOCUMENTS 4,039,209 A * 8/1977 Goodlaxson et al. ..... 285/8
4,887,450 A * 12/1989 Gast et al. ..... 29/243.523
5,300,050 A * 4/1994 Everett et al. ..... 604/320
6,638,066 B2 * 10/2003 Hubner et al. ..... 433/92
6,651,343 B2 * 11/2003 Laren et al. ..... 30/133
6,666,072 B2 * 12/2003 Hirano et al. ..... 73/49.7
6,957,742 B1 * 10/2005 Pillart ..... 210/436
2006/0110261 A1 * 5/2006 Muhs ..... 417/68
2006/0185737 A1 * 8/2006 Williamson et al. ..... 137/538
2009/0178378 A1 * 7/2009 Bertram et al. ..... 55/391

* cited by examiner

*Primary Examiner* — Peter J Bertheaud
*Assistant Examiner* — Dominick L Plakkoottam
(74) *Attorney, Agent, or Firm* — W. Scott Carson

(57) ABSTRACT

A combined debris catcher and pressure relief valve positionable between first and second ports of an inlet arrangement that is upstream of the main body of a vacuum pump. The debris catcher includes an open ended tube that is spring biased upwardly and in normal operation forms a seal with the inlet arrangement. In the raised or sealed position, incoming fluid from the system to be evacuated travels along a closed flow path through the first port of the inlet arrangement, through the debris catcher, and out through the second port of the inlet arrangement into the main body of the vacuum pump. If the inlet arrangement is hooked up initially or at any time to a system that is above atmospheric pressure, the above atmospheric pressure will overcome the upward force of the spring on the tube and cause the tube to move to an open position spaced from the inlet arrangement harmlessly venting the high pressure fluid to ambient air and avoiding potential damage or contamination to the pump.

10 Claims, 5 Drawing Sheets

VACUUM PUMP WITH COMBINED DEBRIS CATCHER AND PRESSURE RELIEF VALVE

RELATED APPLICATIONS

This application claims the benefit of U.S. Provisional Patent Application Ser. No. 61/096,653 filed Sep. 12, 2008, which is incorporated herein by reference.

BACKGROUND OF THE INVENTION

1. Field of the Invention

This invention relates to the field of debris catchers and pressure relief valves for vacuum pumps and more particularly to the field of debris catchers and pressure relief valves for portable vacuum pumps for refrigeration systems.

2. Discussion of the Background

Refrigeration or air conditioning systems are typically closed systems that use a refrigerant normally mixed with a quantity of refrigeration oil. The oil in this regard is necessary primarily to maintain lubrication for the system's compressor and other moving parts. In use, a quantity of this oil inevitably ends up circulating in all of the system's flow paths (e.g., tubing) as it is carried along with the refrigerant. This includes in paths and parts of the pump where the refrigerant changes states (e.g., from liquid to vapor as it picks up heat and vapor to liquid as it gives up heat).

During service or repair of such refrigeration or air conditioning systems both large and small, the refrigerant is normally removed and captured and the system then typically opened up to atmosphere to perform the service work or part replacement. This process of opening the system up to atmosphere exposes all of the internal plumbing of the system to air and atmospheric moisture. Both of these compounds are very destructive to the efficient working of the normal refrigeration cycle of an operating system. Consequently, after the system has been repaired and closed back up, it is necessary to draw it into a deep vacuum (e.g., 500 microns) in order to completely remove all of the air, atmospheric moisture, and other contaminants prior to recharging the system with refrigerant. This evacuation process is critical and necessary as the refrigerant system will otherwise perform poorly if the recharged refrigerant is contaminated with air or other compounds including water vapor.

A common problem is that after a system has been evacuated and all of the refrigerant seemingly recovered and the system seemingly at atmospheric pressure, residual refrigerant will continue to bubble out of the system's remaining oil even in the case where a system has been left open to atmosphere for some time. This is similar to the carbon dioxide that continues to bubble out of a can of soda pop for quite some time as it sits open to atmosphere. Further, just as an open bottle of soda pop rebuilds pressure after the cap has been put back on, a refrigeration system builds up pressure once the system is resealed as the refrigerant bubbles out of the residual oil.

When a service technician then goes to hook up a vacuum pump to the system, he can be presented with a surprising condition. More specifically, he can find that the system he thought was at atmosphere or resealed at atmosphere has actually built up internal pressure above atmospheric pressure. Since vacuum pumps are typically not designed to handle being hooked up to pressure above atmosphere, the technician can be quite startled to find oil blowing out of the top of his vacuum pump as the built up pressure in the system enters and is then released through the inner workings of the vacuum pump. Additionally, the built up pressure in the system to be evacuated may blow the vacuum pump oil out of its sump as well as blow contaminating refrigerant oil from the system into the vacuum pump. The result is that the vacuum pump must or at least should be thoroughly cleaned and refilled with new and relatively expensive vacuum pump oil; otherwise, it will not efficiently work to draw down the system to a deep vacuum (e.g., 500 microns) or at least not do so in a relatively short period of time.

That is, vacuum pump oil in this regard is quite different from refrigerant oil. More specifically, a vacuum pump relies on highly refined special oil to make critical seals in the mechanics of the pump at deep vacuum levels. This oil must have a very low vapor pressure as it cannot boil or outgas at low pressures under vacuum or it will cause the vacuum pump to perform very poorly or even fail. This oil must be keep very clean and dry in order for the vacuum pump to operate well (e.g., pull a deep vacuum in a relatively short period of time). Refrigeration oil, on the other hand, is designed to lubricate and mix well with refrigerant. Refrigeration oil boils fairly readily at moderate vacuums and also tends to absorb many other volatiles like refrigerant, water, and solvents making it even worse for mixing in and essentially ruining the vacuum pump oil.

Most manufacturers of vacuum pumps recommend that the oil be changed in the vacuum pump prior to each and every use. Many technicians actually change the oil several times during large jobs as the oil becomes contaminated with compounds coming out of the system being evacuated such as water vapor, refrigeration oil, and acids. Contaminated vacuum pump oil as indicated above will quickly be rendered inefficient causing very slow evacuation times and/or an inability to draw a desired deep vacuum. In this last regard, it is not uncommon for a service technician to have to run an efficiently operating vacuum pump on a large system (e.g., the frozen food cases in a supermarket or an air conditioner for a hospital or office building) for 3 to 5 days continuously in order to properly draw it down prior to recharging the system with refrigerant. If the pump is not effectively operating, this length of time can be greatly extended potentially causing significant productive and financial losses (e.g., food spoilage or the need to shut down the hospital or office building). It may even cause the system when recharged to fail in short order if the evacuation was not deep or thorough enough.

With this and other problems in mind, the present invention was developed. In it, a combination debris catcher and relief valve is provided at the inlet upstream of the main body of the vacuum pump. In this manner, potentially contaminating debris is continuously caught and prevented from entering and damaging the pump. Additionally, any potentially damaging incoming fluid at pressure above atmospheric is relieved so as not to harm the operating parts of the vacuum pump or otherwise reduce its efficiency.

SUMMARY OF THE INVENTION

This invention involves a combination debris catcher and pressure relief valve positionable between first and second ports of an inlet arrangement that is upstream of the main body of a vacuum pump. The debris catcher includes an open ended tube that is spring biased upwardly and in normal operation forms a seal with the inlet arrangement. In the raised or sealed position, incoming fluid from the system to be evacuated travels along a closed flow path through the first port of the inlet arrangement, through the debris catcher, and out through the second port of the inlet arrangement into the main body of the vacuum pump.

In normal operation with the inlet arrangement connected to a system at atmospheric or lower pressure, the vacuum pump will draw fluid from the system through the inlet arrangement and debris catcher into the main body of the pump. The evacuating pressure of the pump is below atmospheric and will draw the tube of the debris catcher upwardly into a tight sealing position with the inlet arrangement. In this sealing position, the flow path through the first port of the inlet arrangement, through the debris catcher, and out the second port to the main body of the pump is closed to ambient air. The system to be evacuated can then be drawn down to a deep vacuum.

However, if the inlet arrangement is hooked up initially or at any time to a system that is above atmospheric pressure (e.g., due to a pressure build up of residual refrigerant or for whatever reason), the above atmospheric pressure will overcome the upward force of the spring on the tube and cause the tube to move downwardly to an open position at least partially spaced from the inlet arrangement. The undesirable high pressure will then be harmlessly vented to the atmosphere and not allowed to enter the main body of the vacuum pump and potentially damage or contaminate the pump. Once the pressure is relieved, the spring will move the tube upwardly to at least partially engage or seal with the inlet arrangement and the evacuating pump will thereafter draw the tube upwardly into its fully closed and sealed position. The evacuation of the system can then safely proceed.

DETAILED DESCRIPTION OF THE INVENTION

Figure 1:
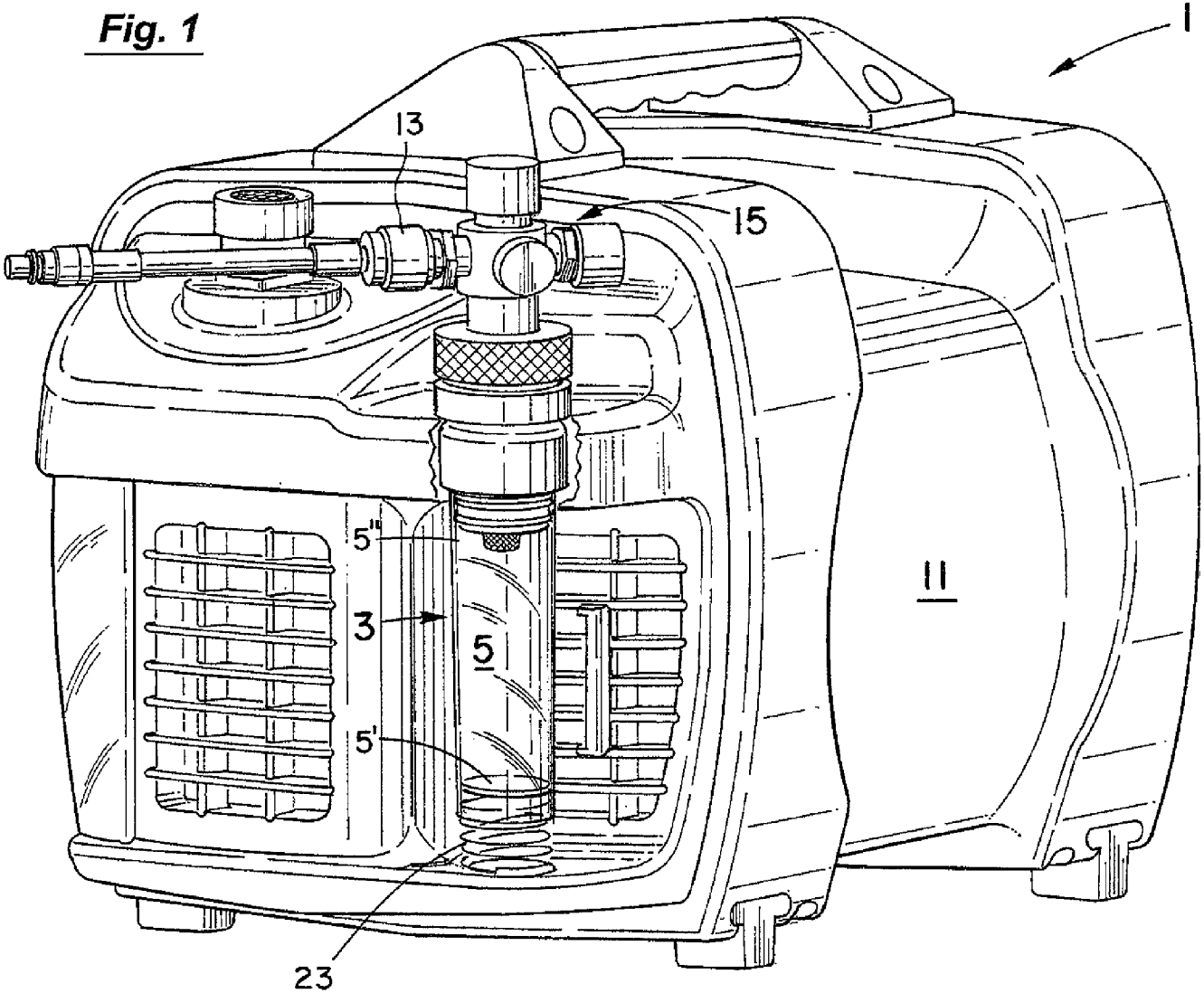
FIG. 1 is a perspective view of the vacuum pump of the present invention illustrating its inlet arrangement and the combination debris catcher and pressure relief valve in their normal operating positions.
Figure 5:
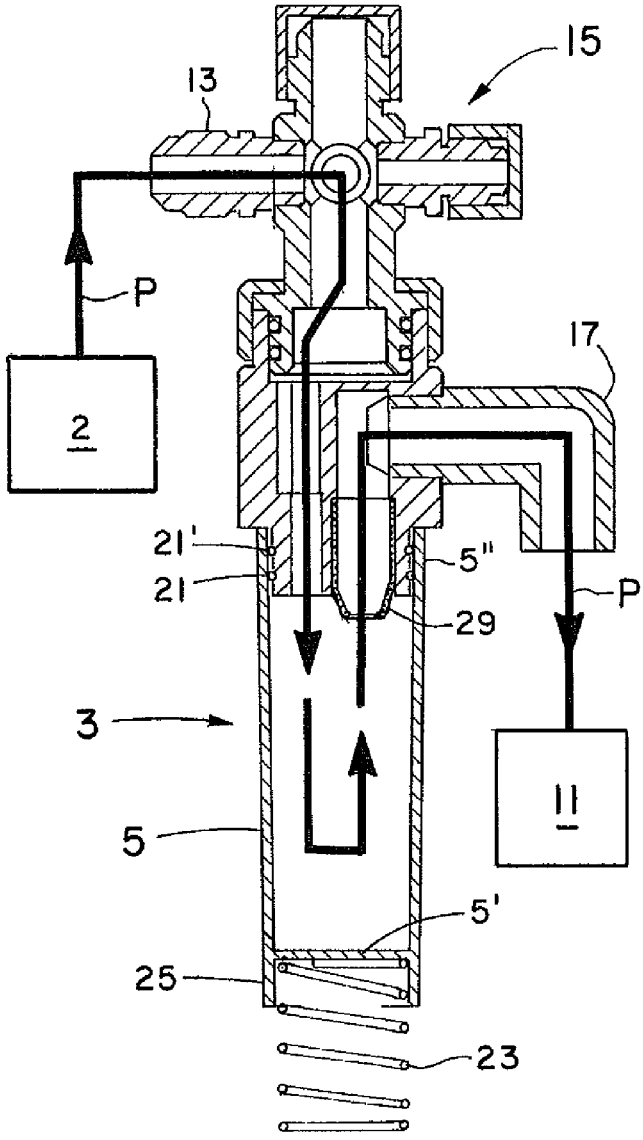
FIG. 5 is a cross-sectional view taken along line 5-5 of FIG. 4 and additionally schematically showing the closed system to be evacuated and the main body of the vacuum pump.

As shown in FIG. 1, the present invention includes a vacuum pump 1 with a combination debris catcher and pressure relief valve 3. The debris catcher as illustrated has a clear tube 5 with a closed bottom 5' (see also FIG. 5) and an open, upper end 5". In normal operation, the main body 11 of the pump 1 of FIG. 1 draws a vacuum to induce a flow along path P (FIG. 5) from a system 2 to be evacuated through the first or inlet port 13 of the inlet arrangement 15 (FIGS. 1 and 5). The fluid then travels down through the tube 5 of the debris catcher (FIG. 5) and out the second or outlet port 17 of the inlet arrangement 15 into the main body 11 of the pump 1.

In normal operation as illustrated in FIGS. 1 and 5, the upper end 5" of the tube 5 is fully raised and sealed against the inlet arrangement 15 (FIG. 5) under the vacuum draw of the pump main body 11 in the closed flow path P of the incoming fluid. More specifically, the reduced pressure in the flow path P of FIG. 5 created by the main body 11 of the pump 1 allows the higher atmospheric pressure of the ambient air on the underside of the bottom 5' of the tube 5 to push the tube 5 upwardly into the fully sealing position about the two O-rings 21,21'. The pump 1 can then continue to operate to draw a deep vacuum (e.g., 500 microns) in the system 2 hooked up to it.

Figure 2:
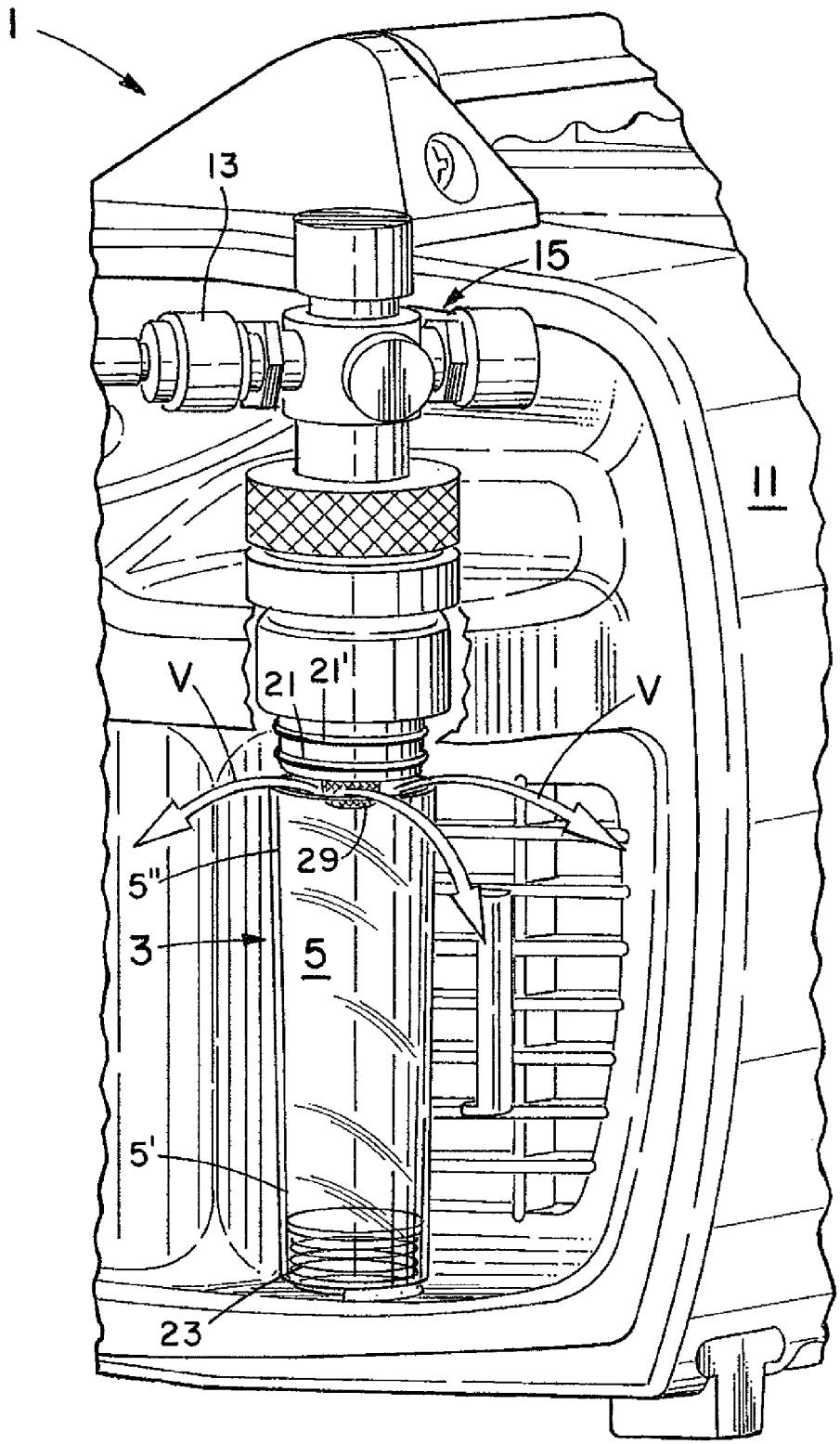
FIG. 2 is a perspective view of the vacuum pump with its debris catcher in its open position spaced from the inlet arrangement and serving as a relief valve to vent incoming fluid at pressure above atmospheric and prevent the high pressure fluid from entering and possibly damaging or contaminating the main body of the vacuum pump.
Figure 3:
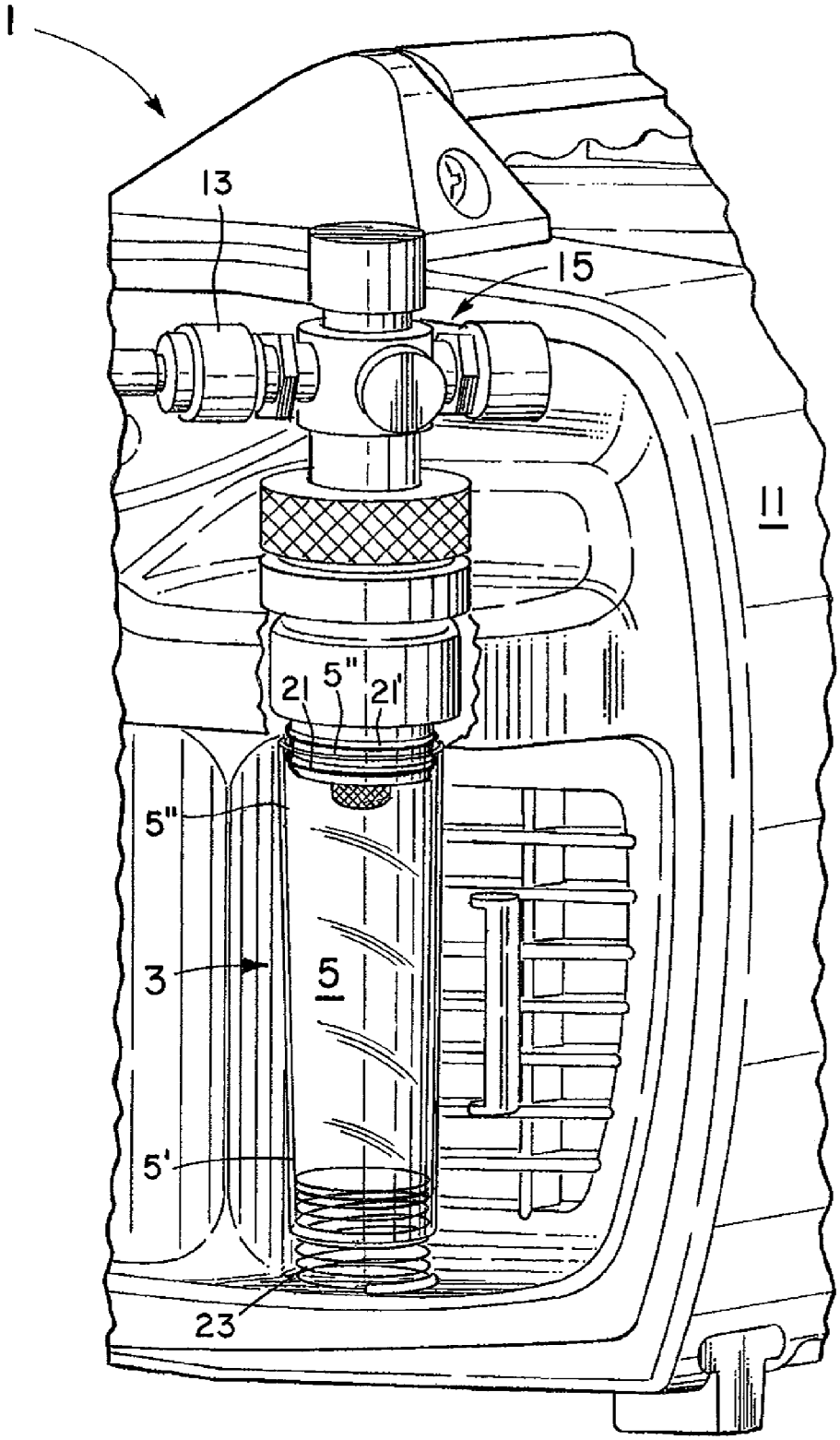
FIG. 3 is a perspective view of the vacuum pump of FIG. 2 after the potentially harmful high pressure fluid has been vented and the spring under the tube of the debris catcher has moved the open, upper end of the tube upwardly into at least partial engagement with the inlet arrangement after which the evacuating pump can draw the tube into its fully raised, sealing position of FIG. 1.

The tube 5 of the combined debris catcher and pressure relief valve 3 of FIGS. 1 and 5 has a spring 23 that biases the tube 5 upwardly. The force of the spring 23 is such that it is just slightly more than needed to counter the downward weight of the tube 5. In this manner, the compressed spring 23 after a venting V as in FIG. 2 and as explained in more detail below will move the tube 5 upwardly into at least partial engagement (FIG. 3) with the inlet arrangement 15 to form at least a partial seal therewith. With the potentially harmful pressure above atmospheric of FIG. 2 vented at V and the incoming line pressure safely at or below atmospheric, the operating vacuum pump 1 will then draw the tube 5 upwardly into its fully raised and sealed position with both O-rings 21,21' (FIGS. 1 and 5). Preferably, the upward force of the spring 5 after the venting of FIG. 2 is set so that it will push the upper end 5" of the tube 5 upwardly about the lower O-ring 21 of the two O-rings 21,21' (FIG. 3). The operating pump 1 can then very quickly and easily draw the tube 5 into its fully raised and vacuum tight, sealed position of FIGS. 4-5 about both O-rings 21,21'.

Figure 4:
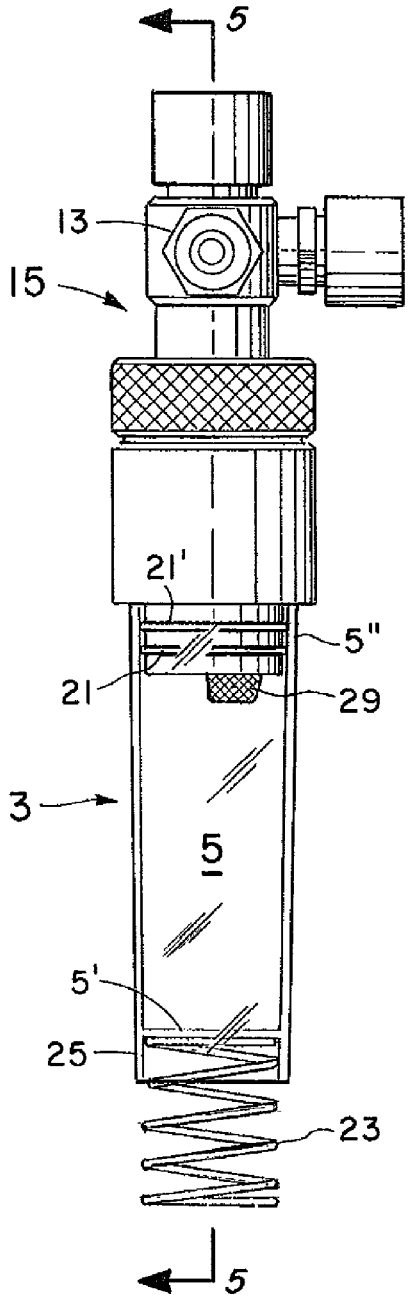
FIG. 4 is a view of the inlet arrangement and the tube and spring of the combined debris catcher and pressure relief valve in the normal operating position of FIG. 1.

The top of the coil spring 23 in this regard is captured within the downwardly extending rim 25 of the tube bottom 5' (see FIGS. 4-5). During the venting V of FIG. 2 when the spring 23 is depressed and the combined debris catcher and relief valve 3 open to ambient air, the closed door 27 of FIG. 6 helps to maintain the substantially vertical alignment of the tube 5. The depending filter screen 29 in FIGS. 4-6 also aids to keep the lowered tube 5 of FIG. 2 substantially vertically aligned so the spring 23 can subsequently move it upwardly to the position of FIG. 3.

In this manner and in the event the vacuum pump 1 is initially or otherwise hooked up to a system at a potentially harmful pressure above atmospheric as in FIG. 2, the incoming fluid at above atmospheric pressure will overcome the upward force of the spring 23 on the tube 5 and cause the tube 5 to move downwardly to its open position (FIG. 2). In this position, the tube 5 is spaced from its sealed engagement with the inlet arrangement 15. The undesirable high pressure fluid will then be harmlessly vented at V in FIG. 2 to the atmosphere and not allowed to enter the main body 11 of the vacuum pump 1 and potentially damage or contaminate the pump 1. The tube 5 in this regard preferably pops off the inlet arrangement 15 creating an audible sound or signal when positive pressure above atmospheric has been inadvertently applied. This will then notify the technician of the error while doing no harm to the vacuum pump 1. Once the pressure is relieved, the spring 23 as previously discussed will move the tube 5 upwardly to at least partially engage or seal with the inlet arrangement 15 (FIG. 3) and the evacuating pump 1 will thereafter draw the tube 5 upwardly into its fully closed and sealed position of FIG. 5. The evacuation of the system 2 can then safely proceed.

Figure 6:
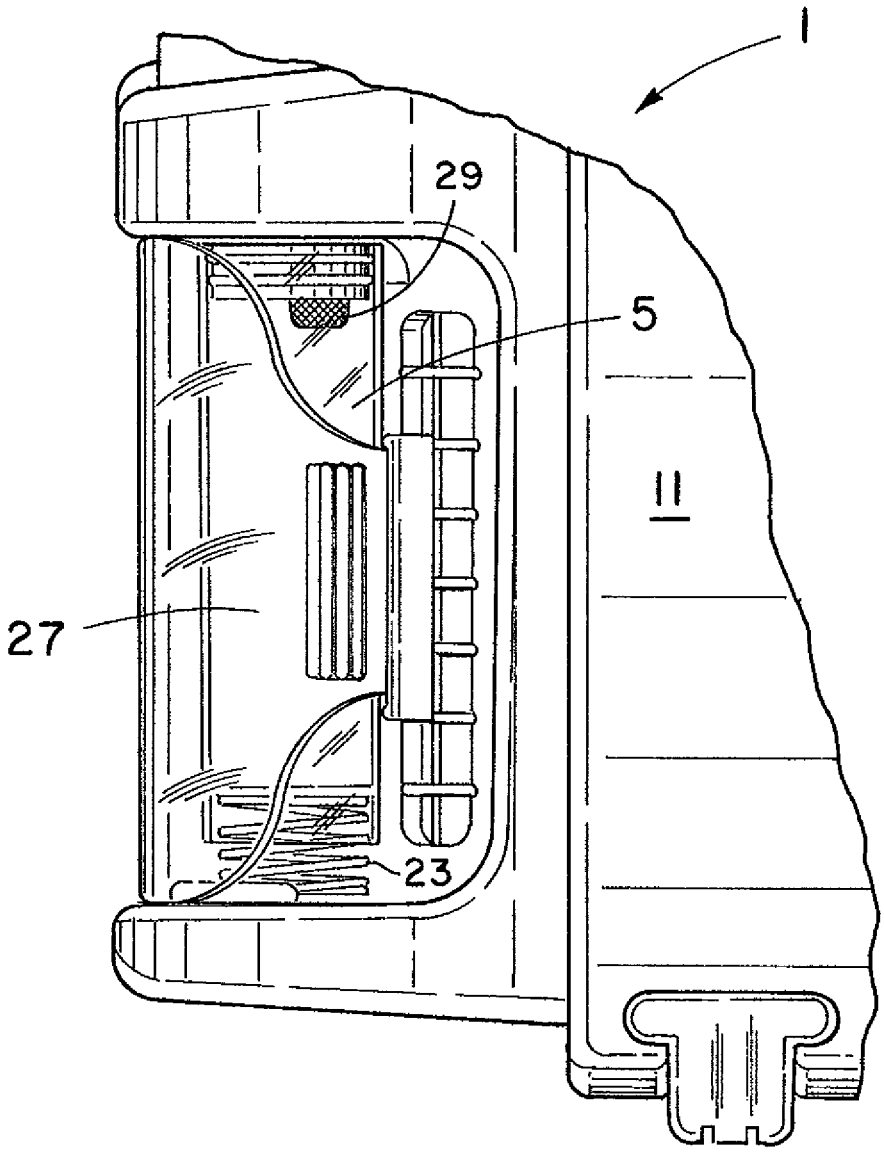
FIG. 6 is a side view of the tube of the debris catcher showing the clear plastic door that helps to contain it in position.

The tube 5 of the present invention is preferably made of clear plastic or other material as is the covering door 27 of FIG. 6 so that the debris caught in the tube 5 can be visually monitored. When it is full or otherwise needs to be emptied, the door 27 of FIG. 6 can be pivoted open with the pump 1 turned off and the tube 5 manually depressed against the force of the spring 23 and removed to dump out the debris. Upon reinserting the tube 5, the spring 23 will again raise the tube 5 into at least partial engagement or sealing with the inlet arrangement 15 as in FIG. 3. Thereafter and upon turning the pump 1 on for the evacuating operation, the tube 5 will be drawn upwardly as explained above into its fully raised and sealing position of FIGS. 1, 4, and 5. At the end of the evacuating operation, the pump 1 will be turned off and allowed to return to atmospheric pressure. In doing so, the tube 5 will preferably remain firmly in its position of FIGS. 4-5 under the friction of the O-rings 21,21' and as helped by the minimal upward force of the spring 23 on the bottom 5' of the tube 5. Should the pump 1 thereafter be inadvertently or otherwise hooked up to pressure above atmospheric, the venting maneuver of FIG. 2 will be put into operation.

In summary, the present invention involves a vacuum pump 1 having a main body 11, an inlet arrangement 15 to the main body 11, and a combined debris catcher and positive pressure relief valve 3. The inlet arrangement 15 has a first or inlet port 13 (FIG. 5) and a second or outlet port 17. The combined debris catcher and relief valve 3 is then selectively movable between a sealing position (FIGS. 4-5) with the inlet arrangement 15 and an open position (FIG. 2). In the sealing position of FIG. 5, the combined debris catcher and relief valve 3 forms a closed flow path P from the inlet port 13 of the inlet arrangement 15 connected in fluid communication with the system 2 to be evacuated through the combined debris catcher and relief valve 3 and out through the outlet port 17 of the inlet arrangement 15 into the main body 11 of the pump 1. In the open or venting position of FIG. 2, the combined debris catcher and relief valve 3 exposes the flow path P of FIG. 5 to ambient air.

In the normal mode of operation with the combined debris catcher and relief valve 3 in its sealing position, the main body 11 of the pump 1 draws fluid at pressure below atmospheric through the closed path P of FIG. 5 connected and in fluid communication with the closed system 2 to be evacuated. In a second or venting mode with the fluid entering the inlet port 13 from the system 2 at pressure above atmospheric, the combined debris catcher and relief valve 3 is moved to its open position (FIG. 2) to vent the high pressure fluid entering the inlet port 13 of the inlet arrangement 15 to the ambient air upstream of the outlet port 17 of FIG. 5. The potentially damaging, high pressure fluid is then harmlessly diverted from entering the main body 11 of the pump 1.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims. In particular, it is noted that the word substantially is utilized herein to represent the inherent degree of uncertainty that may be attributed to any quantitative comparison, value, measurement or other representation. This term is also utilized herein to represent the degree by which a quantitative representation may vary from a stated reference without resulting in a change in the basic function of the subject matter involved.

I claim:

1. A vacuum pump for evacuating a system to a pressure below ambient, atmospheric pressure, said vacuum pump having a main body, an inlet arrangement, and a combined debris catcher and positive pressure relief valve to relieve pressure above ambient, atmospheric pressure to the ambient air, said inlet arrangement having first and second ports and said combined debris catcher and positive pressure relief valve being selectively movable between a sealing position with said inlet arrangement and an open position, said combined debris catcher and positive pressure relief valve in said sealing position forming a closed flow path from the first port of the inlet arrangement connectable in fluid communication with the system to be evacuated through the combined debris catcher and positive pressure relief valve and out through the second port of the inlet arrangement into the main body of the pump, said combined debris catcher and positive pressure relief valve in said open position exposing said flow path to ambient air, said combined debris catcher and positive pressure relief valve being spring biased toward said sealing position wherein in one mode of operation with the combined debris catcher and positive pressure relief valve in said sealing position, the main body of the pump draws fluid at pressure below said ambient, atmospheric pressure through the first port of the inlet arrangement from the system through the combined debris catcher and positive pressure relief valve and out through the second port of the inlet arrangement into the main body of the pump and wherein in another mode of operation with the fluid entering the first port at pressure above ambient, atmospheric pressure the combined debris catcher and positive pressure relief valve is moved to said open position to vent the fluid entering the first port at pressure above ambient, atmospheric pressure to the ambient air upstream of the second port wherein said combined debris catcher and positive pressure relief valve in said sealing position includes a tube to collect therein debris passing along said closed flow path from the first port of the inlet arrangement connectable in fluid communication with the system to be evacuated through the combined debris catcher and positive pressure relief valve including through the tube therein and out through the second port of the inlet arrangement into the main body of the pump, said tube extending between an open upper end and a closed lower end with said spring biasing said upper end toward said sealing position with said inlet arrangement.

2. The vacuum pump of claim 1 wherein said tube is made of substantially clear material.

3. The vacuum pump of claim 1 wherein the closed lower end of said tube has a downwardly extending rim and said spring has a top engaging the lower end of the tube within said rim.

4. The vacuum pump of claim 1 wherein the upper end of the tube is drawn by the main body of the pump into said sealing position in said one mode of operation.

5. The vacuum pump of claim 1 wherein said inlet arrangement has at least one O-ring sealingly engaging the tube at said upper end thereof in said one mode of operation.

6. The vacuum pump of claim 5 wherein said inlet arrangement has a second O-ring sealingly engaging the tube at said upper end thereof in said one mode of operation.

7. The vacuum pump of claim 5 wherein said spring moves said tube into at least partial sealing engagement with said at least one O-ring after the venting of said another mode of operation.

8. The vacuum pump of claim 1 wherein said spring is a coil spring.

9. The vacuum pump of claim 1 wherein said tube is elongated between said open upper end and said closed lower end.

10. The vacuum pump of claim 1 further including a filter in the second port wherein said combined debris catcher and positive pressure relief valve in said one mode of operation in said sealing position forms said closed flow path from the first port of the inlet arrangement connectable in fluid communication with the system to be evacuated through the combined debris catcher and positive pressure relief valve, through the filter in the second port, and out through the second port of the inlet arrangement into the main body of the pump and in said second mode of operation with the fluid entering the first port at pressure above ambient, atmospheric pressure and the combined debris catcher and positive pressure relief valve moved to said open position, the fluid entering the first port at pressure above ambient, atmospheric pressure vents to the ambient air upstream of the second port including the filter therein.

* * * * *